United States Patent [19]

Davey

[11] Patent Number: 4,649,676

[45] Date of Patent: Mar. 17, 1987

[54] SHELTER CONSTRUCTION

[76] Inventor: C. Regina Davey, P.O. Box E.G. 599, Melbourne, Fla. 32935

[21] Appl. No.: 872,907

[22] Filed: Jun. 11, 1986

[51] Int. Cl.[4] ..... E04B 1/32; B32B 23/02

[52] U.S. Cl. ..... 52/86; 52/309.15; 52/309.16; 52/537; 52/630; 428/182; 428/192

[58] Field of Search ..... 52/86, 80, 309.15, 309.16, 52/537, 630; 428/182, 192

[56] References Cited

U.S. PATENT DOCUMENTS

| | | | |
|---|---|---|---|
| 2,526,323 | 10/1950 | Blaski | 52/86 X |
| 2,742,114 | 4/1956 | Behlen | 52/630 X |
| 2,984,076 | 5/1961 | Bradley | 52/86 X |
| 3,057,119 | 10/1962 | Kessler | 52/86 X |
| 3,187,852 | 6/1965 | Carman et al. | 52/86 X |
| 3,203,143 | 8/1965 | Swenson | 52/64 |
| 3,405,487 | 10/1968 | Van De Kerke | 52/86 X |
| 3,432,859 | 3/1969 | Jordan et al. | 52/797 X |
| 3,674,620 | 7/1972 | McCarthy et al. | 428/182 X |
| 3,748,796 | 7/1973 | Ouellet | 52/86 |
| 3,851,786 | 12/1974 | Kaempen | 52/309.16 X |
| 3,995,081 | 11/1976 | Fant et al. | 52/630 X |
| 4,028,861 | 6/1977 | Huddle | 52/86 X |
| 4,068,423 | 1/1978 | Marsh | 52/86 |
| 4,258,514 | 3/1981 | St. Clair | 52/86 |
| 4,312,162 | 1/1982 | Medney | 52/309.16 |

FOREIGN PATENT DOCUMENTS

| | | | |
|---|---|---|---|
| 602190 | 7/1960 | Canada | 52/537 |
| 2225989 | 11/1974 | France | 52/309.15 |
| 526586 | 9/1940 | United Kingdom | 52/86 |

*Primary Examiner*—Alfred C. Perham
*Attorney, Agent, or Firm*—Nies, Webner, Kurz & Bergert

[57] ABSTRACT

A quonset type arched roof shelter construction is disclosed. In one embodiment, the shelter is constructed of corrugated laminated fiberglass panels, each of which has a corrugated construction throughout the main central portion of the length thereof and a molded end portion at each end. The corrugations of each panel have a maximum amplitude midway between the respective end portions and with the amplitude being reduced as the corrugations taper into a generally flat configuration adjacent the end portions. The panels may have a length such as about two feet, with a structure of any desired length being obtained by joining overlapping end portions of successive panels. The number of plies in the laminated panels may be varied throughout the height of the structure and various reinforcing materials may be employed between laminations of fiberglass.

15 Claims, 7 Drawing Figures

SHELTER CONSTRUCTION

BACKGROUND AND SUMMARY OF THE INVENTION

The present invention relates to a shelter or building construction. More particularly, the present invention relates to a quonset type arched roof building construction having a corrugated outer surface formed of multiple plies of fiberglass.

Previous corrugated structures are described in the following U.S. Pat. Nos. 2,526,323 to Blaski; 2,984,076 to Bradley; 3,187,852 to Carman et al.; 3,203,143 to Swenson; 3,432,859 to Jordan et al.; and 4,068,423 to Marsh.

By the present invention, there is provided an improved corrugated building construction in which a structure of a generally quonset shape is constructed of a plurality of laminated plies of fiberglass, and in which the number of plies as well as the arrangement of the corrugations is so provided as to result in a structure of remarkable strength and durability.

DESCRIPTION OF THE PREFERRED EMBODIMENTS

Figure 1:
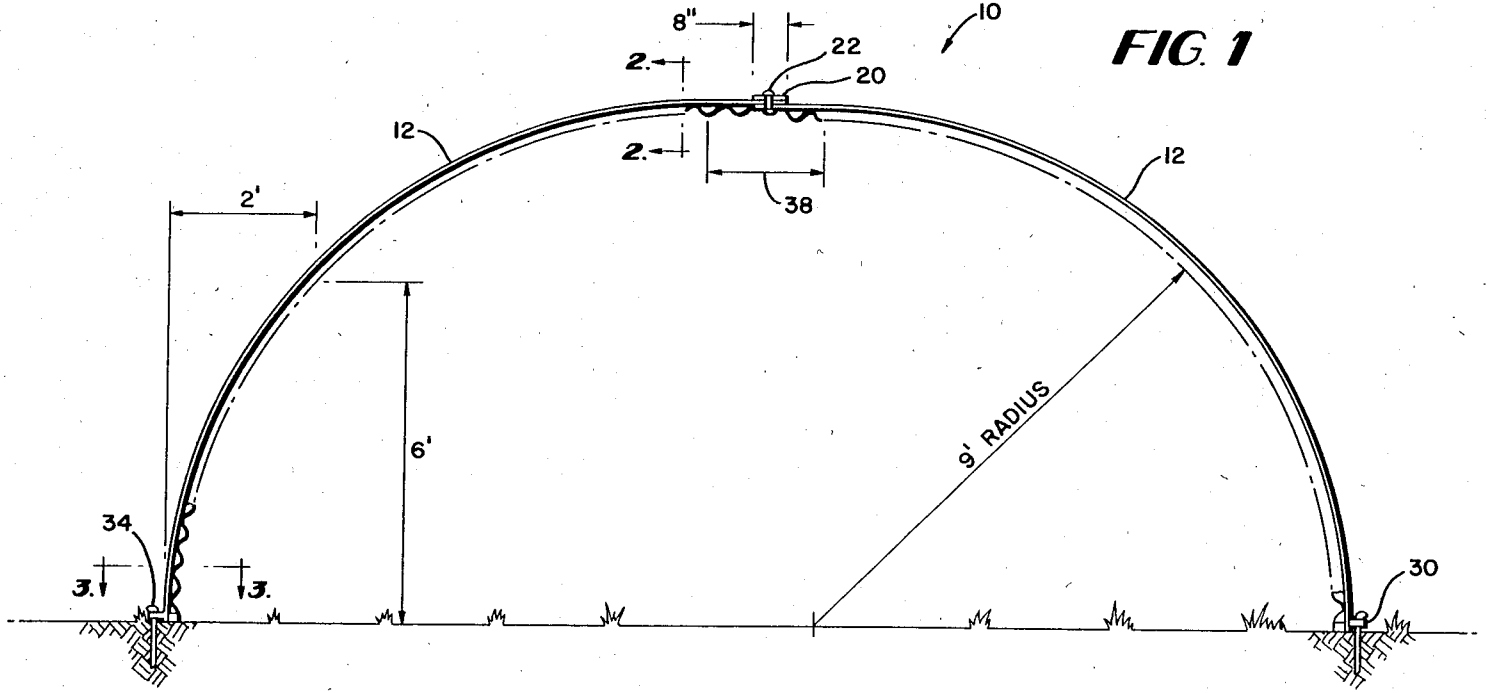
FIG. 1 is a front elevation of a shelter constructed in accordance with the present invention.
Figure 2:
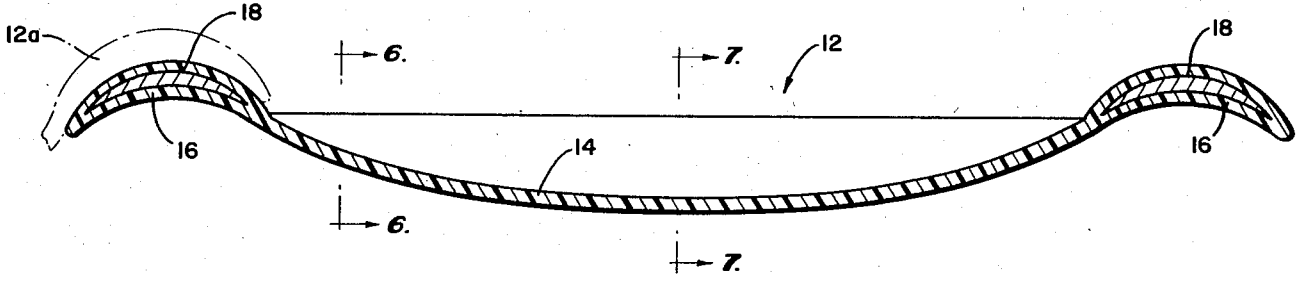
FIG. 2 is an enlarged cross sectional view of a rib section of the shelter, taken along line 2—2 of FIG. 1.

In the embodiment of the invention as shown in FIGS. 1 through 7, there is provided a shelter construction 10 in the general shape of a semicircular arch. The arch is formed of one or more pairs of arcuate structural panels 12 which together form the semicircular arch. Each panel 12 is constructed of laminated fiberglass having a corrugated structure 14 throughout the major portion of the length thereof, as shown in FIG. 2, and with molded end portions 16 which are reinforced with chopped fiberglass 18.

The two panels 12 which form each pair of panels are formed so as to overlap at the upper central portions of the arch, as shown in FIG. 1, with a flat plate member 20 being provided to extend over the union of the overlapping panels 12, and with a bolt 22 or similar means extending through the plate 20 and the overlapping end portions of the panels 12 to secure the panels 12 together. The number of pairs of panels 12 to be joined will depend on the desired length of the overall structure. Consecutive adjacent panels 12 and **12*a* can be joined as shown in FIG. 2, using a suitable adhesive to secure panels 12 and 12*a* together. Thus an arch shaped structure of any desired length may be formed by joining together the required number of panels 12**.

Each structural panel 12 of the arch is formed of fiberglass layers which are laminated in accordance with conventional methods known in the art. In one embodiment, each panel 12 is formed of five plies of laminated fiberglass up to a vertical height of 6 feet on either side, and with the remainder of the arch being of four ply construction. This vertical height of 6 feet will correspond to a lateral distance of about 2 feet, as shown in FIG. 1. As an example, the individual plies of fiberglass may have a thickness of about $\frac{1}{8}$ inch.

Figure 5:
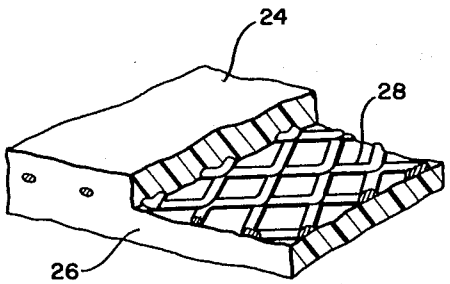
FIG. 5 is a partial section of one embodiment of the laminated material employed in the construction of the shelter of the present invention.

In a second embodiment of the panel 12, a three ply structure having two layers 24, 26 of fiberglass reinforced with an intermediate layer 28 of wire mesh or other reinforcing material is employed as shown in FIG. 5. This embodiment may be varied so that, in a case where the structure is to be used only for storage purposes, a three ply reinforced structure is employed up to a vertical height of about 6 feet on each side, and with a four ply unreinforced material being employed above that point. In one embodiment of the invention, each of the plies 24, 26, 28 had a thickness of about $\frac{1}{8}$ inch.

Figure 7:
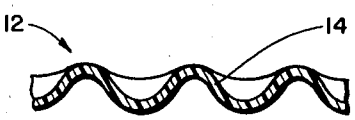
FIG. 7 is a cross sectional view taken along line 7—7 of FIG. 2.
Figure 6:
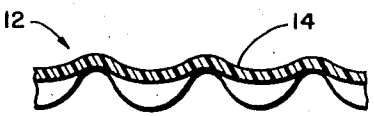
FIG. 6 is a cross sectional view taken along line 6—6 of FIG. 2.

As shown in FIG. 2, each panel 12 has a corrugated structure throughout the main central portion of the length thereof and a molded end portion 16 at each end. The corrugations 14 have a maximum amplitude midway between the respective end portions 16, as shown in FIG. 7, and with the amplitude being reduced as the corrugations 14 taper into a flat configuration adjacent the end portions 16, as shown in FIG. 6.

The end portions 16 may be formed, for example, of four plies of chopped, stringed fiberglass mixed with laminate and blown into a mold plug 18 formed between laminations of the corrugated structure. Such chopped stringed fiberglass may be prepared by any conventional procedure known in the art. The end portions 16 serve as bonding members between adjacent panel members 12 and the distance between centers of adjacent end portions 16 may be an interval of about two feet, for example. As shown in FIG. 2, there will be a slight amount of sag of the panel 12 between adjacent end portions 16. This sag may amount to 2 inches, for example, over the two foot interval between end portions 16. Each end portion 16 may be of a length such as about 4 inches. The individual end portions 16 are preferably formed with an upwardly arched, crescent shaped construction in cross section, as shown in FIG. 2, which has been found to provide additional strength to the panel members 12.

The corrugations 14 of each panel 12 may have a maximum vertical height midway between the respective end portions 16 of, for example, about 1 inch and with an interval or wave length between successive vertical peaks of about 2 inches. In general the interval between successive vertical peaks will be about twice the maximum height of the individual corrugations.

Figure 3:
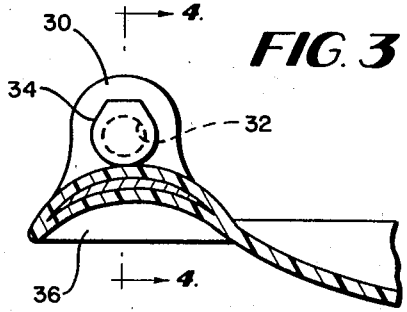
FIG. 3 is an enlarged plan view of a shelter end portion as attached to the ground.
Figure 4:
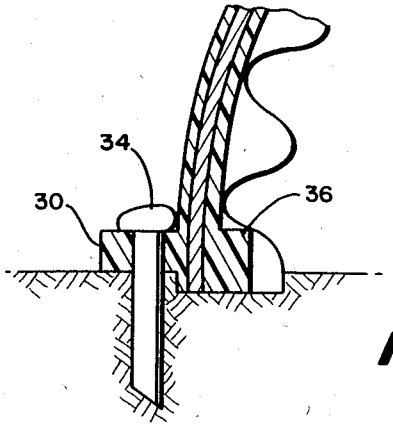
FIG. 4 is a cross sectional view taken along line 4—4 of FIG. 3.

As shown in FIGS. 3 and 4, the lower end portions of the panels 12 may terminate in a horizontal plug 30 having an opening 32 therein for use in receiving a spike 34 which secures each panel 12 to the ground. An internal reinforcement rib 36 is provided on the interior of the fiberglass plies of the panel 12 to maintain structural rigidity at the base of each panel 12.

It is desirable that the top of the finished structure be substantially flat at the center portion thereof. Accordingly, as shown in FIG. 1, each panel 12 may be formed as an arch of a circle such as that shown with a radius of 9 feet, and with the center of the circle being offset from the vertical axis of the arch 10 by a horizontal distance such as about 1 foot. By forming the panel 12 on each side in this manner, and by forming the remainder of the upper end of each panel 12 with a flattened configuration, a substantially flat center portion will be formed, having an overall horizontal dimension 38 such as about 2 feet.

The invention may be embodied in other specific forms without departing from the spirit or essential characteristics thereof. The present embodiments are therefore to be considered in all respects as illustrative and not restrictive, the scope of the invention being indicated by the appended claims rather than by the foregoing description, and all changes which come within the meaning and range of equivalency of the claims are therefore intended to be embraced therein.

What is claimed and desired to be secured by Letters Patent is:

1. An arcuately formed structure comprising at least one panel of laminated ply material, said panel having a corrugated construction throughout the main central portion of the length thereof and a molded end portion at each end, said length being measured transversely to the circumferential dimension of said arcuately formed structure, the corrugations of each panel having a maximum amplitude midway between the respective end portions and with the amplitude being reduced as the corrugations taper into a generally flat configuration adjacent said end portions.

2. The structure of claim 1 wherein a pair of panels are connected at the upper ends thereof to form an arch shaped construction.

3. The structure of claim 2 wherein said pair of panels overlap at the upper central portion of the arch, with a flat plate member being secured to said overlapping panels.

4. The structure of claim 2 wherein said structure is formed with a flat center portion obtained by forming the arc of each panel as a circular arc obtained with the center of the circle offset from the vertical axis of said structure.

5. The structure of claim 1 wherein each panel is formed of laminated fiberglass, with the panel including five plies of laminated fiberglass up to a vertical height of 6 feet and with the remainder of each panel being of four ply construction.

6. The structure of claim 5 wherein the vertical height of 6 feet corresponds to a lateral distance of about 2 feet relative to the lower end of said panel.

7. The structure of claim 1 wherein each panel is formed at least partly of laminated fiberglass having a layer of reinforcing material sandwiched between adjacent layers of fiberglass.

8. The structure of claim 7 wherein each panel includes a three ply construction up to a vertical height of 6 feet, said three ply construction including two plies of fiberglass having a layer of reinforcing material sandwiched between said plies of fiberglass.

9. The structure of claim 8 wherein said panel is formed of a four ply unreinforced fiberglass material above a material height of 6 feet.

10. The structure of claim 7 wherein said reinforcing material is wire mesh having a thickness of about $\frac{1}{8}$ inch.

11. The structure of claim 1 wherein each molded end portion is formed of laminated fiberglass having chopped, stringed fiberglass blown into a mold plug formed between laminations of the corrugated structure.

12. The structure of claim 1 wherein the lower end portion of each panel terminates in at least one horizontal plug having an opening therein for receiving a spike which secures each panel to the ground.

13. The structure of claim 1 wherein the interval between successive vertical peaks of said corrugated construction is approximately twice the maximum height of the individual corrugations.

14. The structure of claim 1 wherein said laminated ply material is in the form of laminated fiberglass wherein each individual ply has a thickness of about $\frac{1}{8}$ inch.

15. The structure of claim 1 wherein an end portion of at least one panel is formed with an upwardly arched, crescent shaped construction in cross section.

* * * * *